US005123455A

United States Patent [19]

Maina

[11] Patent Number: 5,123,455

[45] Date of Patent: Jun. 23, 1992

[54] WEFT FEEDER WITH APPARATUS FOR BROKEN THREAD REMOVAL

[75] Inventor: Bruno Maina, Valdengo, Italy

[73] Assignee: Roj Electrotex S.p.A., Biella, Italy

[21] Appl. No.: 636,289

[22] Filed: Dec. 31, 1990

[30] Foreign Application Priority Data

Dec. 29, 1989 [IT] Italy ..... 22890 A/89

[51] Int. Cl.[5] ..... D03D 47/34

[52] U.S. Cl. ..... 139/452; 139/450

[58] Field of Search ..... 139/452, 450

[56] References Cited

U.S. PATENT DOCUMENTS

| | | | |
|---|---|---|---|
| 4,924,917 | 5/1990 | Shaw | 139/452 |
| 4,969,489 | 11/1990 | Tanaka et al. | 139/452 X |
| 4,993,459 | 2/1991 | Shaw et al. | 139/452 |
| 4,998,567 | 3/1991 | Shaw | 139/452 |

FOREIGN PATENT DOCUMENTS

| | | |
|---|---|---|
| 0269140 | 6/1988 | European Pat. Off. . |
| 0285592 | 10/1988 | European Pat. Off. . |
| 0355281 | 2/1990 | European Pat. Off. . |
| 0362925 | 4/1990 | European Pat. Off. . |
| 8712946 | 1/1988 | Fed. Rep. of Germany . |

*Primary Examiner*—Andrew M. Falik
*Attorney, Agent, or Firm*—Young & Thompson

[57] ABSTRACT

A weft feeder for gripper or projectile looms comprising a body housing a motor, a drum idly mounted on the motor shaft and held stationary around which a winding arm rotated by the motor winds up a weft yarn reserve, a bracket positioned alongside the drum and carrying sensors to detect and control the yarn reserve as well as a brake to stop the yarn against the end surface of the drum, and three compressed air devices acting on the yarn to automatically restore the continuity of the weft yarn from the feed spool to the loom is disclosed. The first device is positioned at the inlet of the weft feeder to withdraw therefrom broken yarn and introduce therein new yarn fed by the spool. The second device is positioned adjacent to the weft feeder drum to receive the new yarn fed by the first device and by the winding arm to send it to a fixed point. The third device consists of at least a suction nozzle mounted, downstream of the brake, at the end of the weft feeder bracket positioned alongside the drum. The bracket is adapted to move the brake and the suction nozzle from their usual position centered on the weft feeder axis, to a position in which the inlet of the suction nozzle coincides with the fixed point.

9 Claims, 5 Drawing Sheets

WEFT FEEDER WITH APPARATUS FOR BROKEN THREAD REMOVAL

BACKGROUND OF THE INVENTION

The present invention concerns improvements in weft feeders for gripper and projectile looms. More precisely, the object of the invention is to automatically restore in such feeders the continuity of the weft yarn from the feed spool or reel to the loom, in case of yarn breakage or interruption.

DESCRIPTION OF THE RELATED ART

As known to the skilled in the art, the yarn feeding arrangement commonly adopted in shuttleless looms—of the gripper or projectile type—provides for the weft yarn to be drawn from a stationary spool or reel, through one or more guide eyelets, by a weft feeder positioned just upstream of the inlet to the loom warp shed. It is also known that weft feeders equipping these looms essentially comprise: an electric motor for rotating a winding arm; and a drum idly mounted on the motor shaft, but held stationary, around which the arm winds up the weft yarn into even turns, forming a certain amount of weft yarn reserve, detected by sensors carried by a bracket positioned alongside the drum. The bracket also carries means to brake the yarn against the end part of the drum. The weft yarn is drawn from the reserve by the loom in an axial direction, its tension being as uniform as possible and being adjustable by way of the brake means.

According to a known technique, if the weft yarn should break in correspondence of a point along its aforementioned path, yarn interruption is detected by suitably positioned sensors so as to cause prompt stopping of the loom.

In the event that, following yarn breakage, the weft feeder should fully or partly run out of a reserve, it is necessary to re-introduce the yarn manually through the weft feeder: for this purpose, use is generally made of a flexible strip ending with a hook, by which the yarn end is caught to be introduced in the weft feeder, until it comes out of the guide eyelet positioned between the weft feeder and the loom. This operation is rather long and complicated and has to be carried out while the loom is not working, with productivity consequences. It is hence evident that loom users are extremely interested in being able to dispose of systems allowing to automatically introduce and/or re-introduce the weft yarn to feed the loom.

Designers of weft feeders have long been faced with this problem which is now felt more than ever. Mechanical devices have already been proposed to semi-automatically introduce the yarn into the weft feeder, using for example a flexible guiding strip, as in EP-285 592, but these solutions have proved to be complicated and hardly or not at all efficient, especially if the weft feeder is equipped with friction brakes, as lamellae brakes.

It has also been proposed to use air-jet or air-suction pneumatic devices incorporated in the weft feeder, as in DE-G-87 12946-9; these are nevertheless very unreliable in their performances and, moreover involve considerable complications as far as construction.

In both the aforecited solutions, the main difficulties derive from the need to form suitable passages for the yarn in correspondence of critical points of its path—as grooves on the drum surface in the first case and notches on the brake ring in the second case—and from the fact that such grooves and notches involve discontinuities, which may prejudice a regular unwinding of the yarn and a uniform braking thereof, thereby altering the proper working of the weft feeder and thus of the loom.

OBJECT OF THE INVENTION

The object of the present invention is to fully overcome these drawbacks by supplying a weft feeder equipped with means to automatically or semi-automatically restore the continuity of the weft yarn from the spool to the loom, which are efficient, reliable and of relatively simple operation.

SUMMARY OF THE INVENTION

This object is satisfactorily reached with a weft feeder of the already defined type, characterized in that, the means to restore the continuity of the weft yarn consist of three compressed air devices acting on said yarn. The first device, which is positioned at the inlet of the weft feeder, to withdraw therefrom the broken yarn and introduce therein new yarn fed by the spool or reel, comprises at least a first duct connected to the inlet of the weft feeder. Along this duct, there are positioned clamping means, nozzle means and cutting means, and a second duct branching off from the first, close to its outlet into the weft feeder, which also has nozzle means. The second device which is positioned adjacent to the weft feeder drum, to receive the new yarn fed by the first device and by the winding arm and send it to a fixed point, comprises a curved profiled duct. This duct is either open or adapted to open longitudinally towards the drum and has aerodynamic guide means for the yarn. The third device consists of at least a suction nozzle mounted, downstream of the brake means, at the end of the weft feeder bracket positioned alongside the drum. The bracket is mounted on the weft feeder body housing the motor so as to be moved away from the end of the drum, with the brake means, and thus moves the brake means and the suction nozzle from their usual position centered on the weft feeder axis, to a position in which the inlet of the suction nozzle coincides with the fixed point.

A suction mouth—which may form part of the weft feeder or be associated therewith—is suitably combined with the suction nozzle of the third compressed air device, the nozzle cooperating therewith when it is positioned in correspondence of the fixed point.

Additional cutting, clamping and knotting means can advantageously be associated downstream of the weft feeder, between the same and the loom.

The first duct of the first compressed air device can suitably fork into two branches to allow feeding the weft feeder from two spools or reels.

The movement of the bracket away from the body housing the motor can be automatically controlled by a compressed air cylinder or other fluid pressure means or electromechanical devices.

The bracket positioned alongside the weft feeder drum is preferably mounted so as to oscillate away from the drum. It is hinged onto the body housing the motor at its end opposite to that carrying the brake means and the suction nozzle.

The invention also concerns the method—carried out with the aforedescribed weft feeder—to automatically restore the continuity of the weft yarn from the spool or reel to the weft transport means (grippers or projectiles)

of a loom. The method is characterized by the following sequence of steps:

stopping of the loom determined by a signal detecting yarn absence or breakage;

moving the brake means away from the weft feeder drum;

emptying the weft feeder by removal and elimination of any yarn left therein;

introducing new yarn in the weft feeder;

returning the brake means to a working position;

possibly knotting the yarn downstream of the weft feeder by known type knotting means;

forming again the weft yarn reserve on the weft feeder drum;

starting the loom.

Some of the aforementioned steps can alternatively be carried out manually instead of automatically.

BRIEF DESCRIPTION OF THE DRAWINGS

The invention is now described in further detail with reference to some preferred embodiments thereof, illustrated on the accompanying drawings, in which.

DESCRIPTION OF THE PREFERRED EMBODIMENTS

Figure 1:
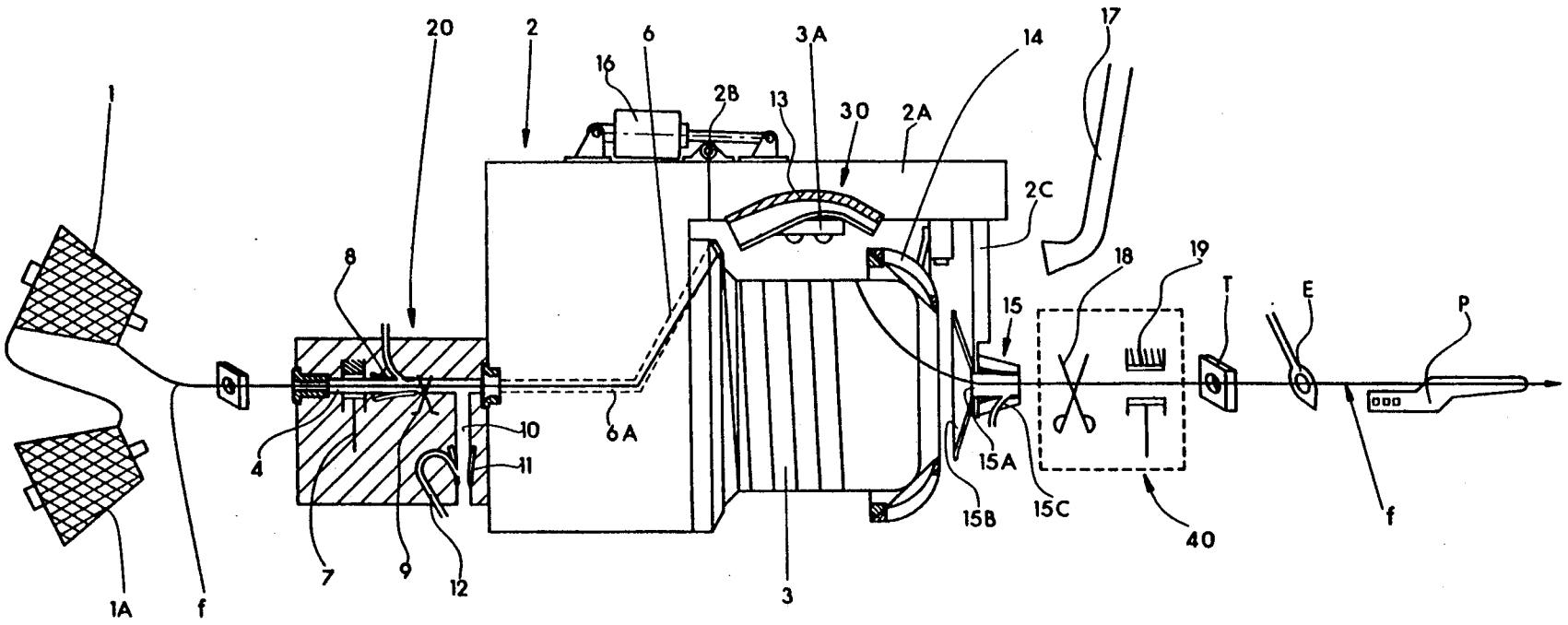
FIG. 1 shows a first embodiment of the weft feeder according to the invention, positioned between the feed spools and the loom.
Figure 2:
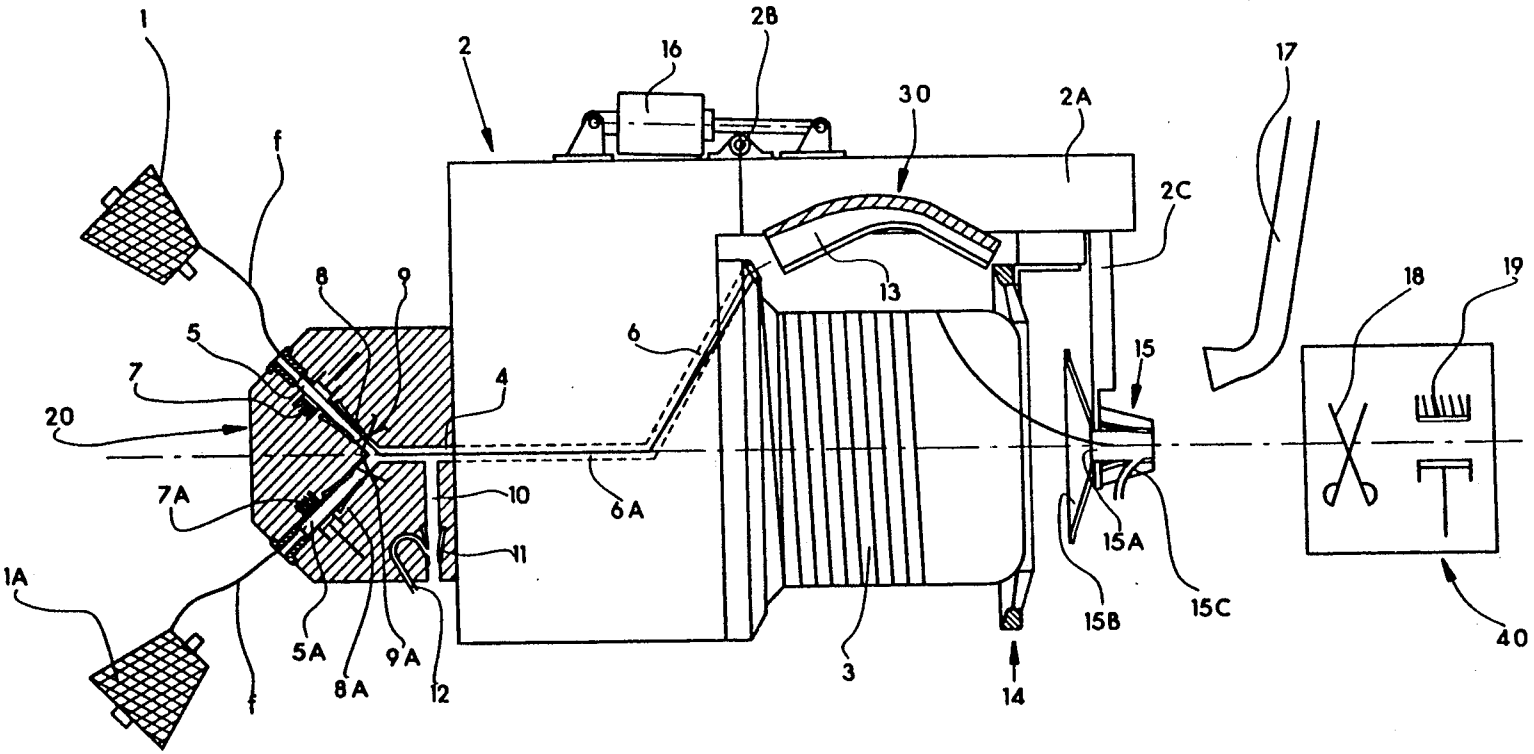
FIG. 2 shows, on an enlarged scale, a modified embodiment of the weft feeder of FIG. 1 in operating conditions.
Figure 3:
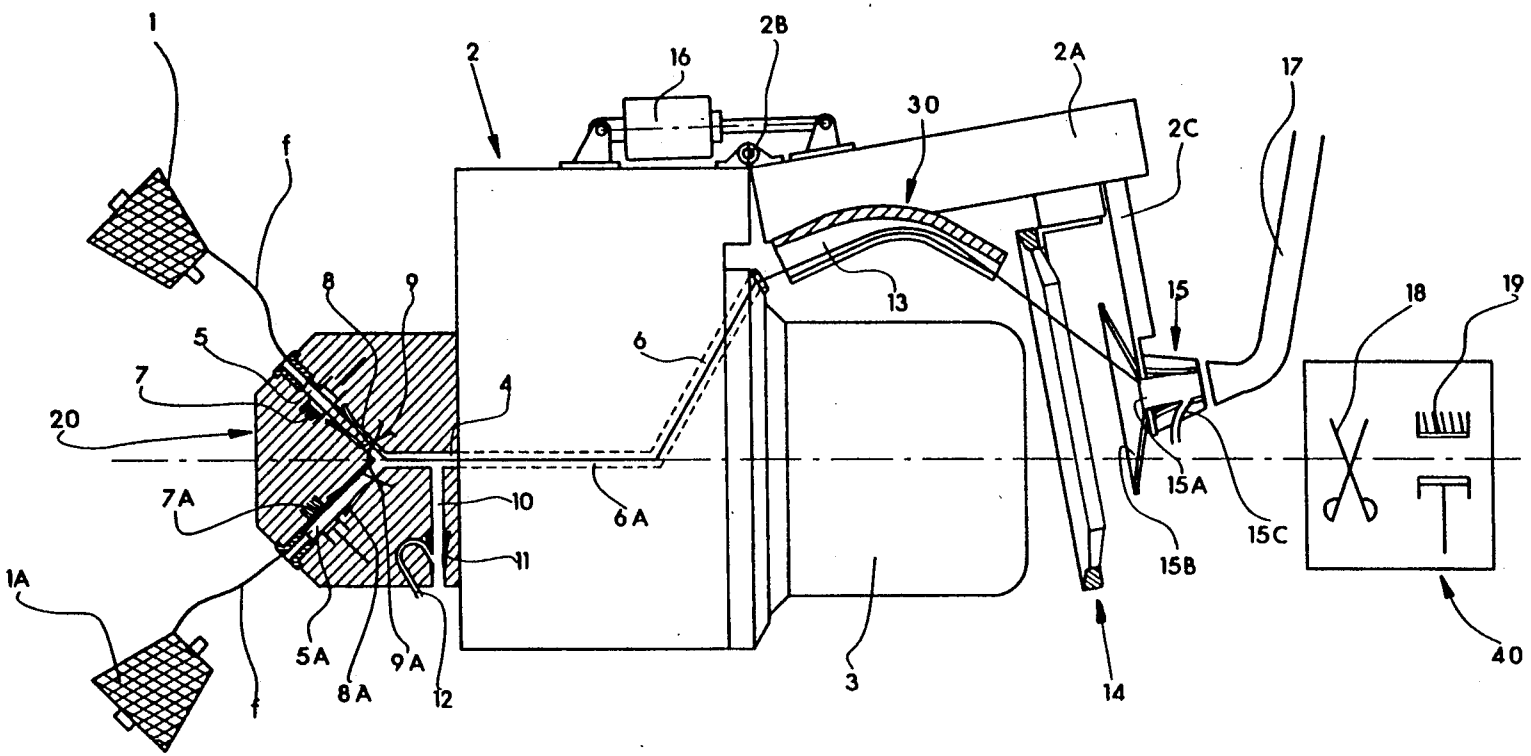
FIG. 3 shows the weft feeder of FIG. 2 with the weft yarn introduced therein.
Figure 4:
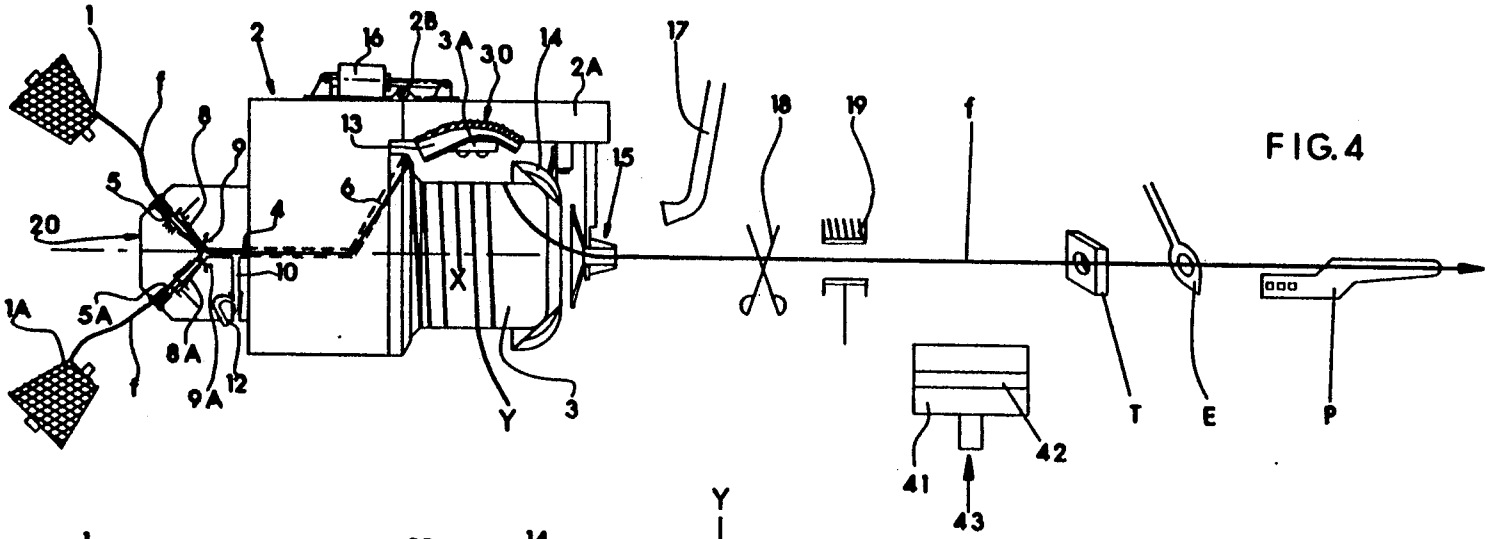
FIGS. 4 to 7 are diagrams showing how the weft yarn is automatically or semi-automatically introduced in a weft feeder according to the invention.
Figure 5:
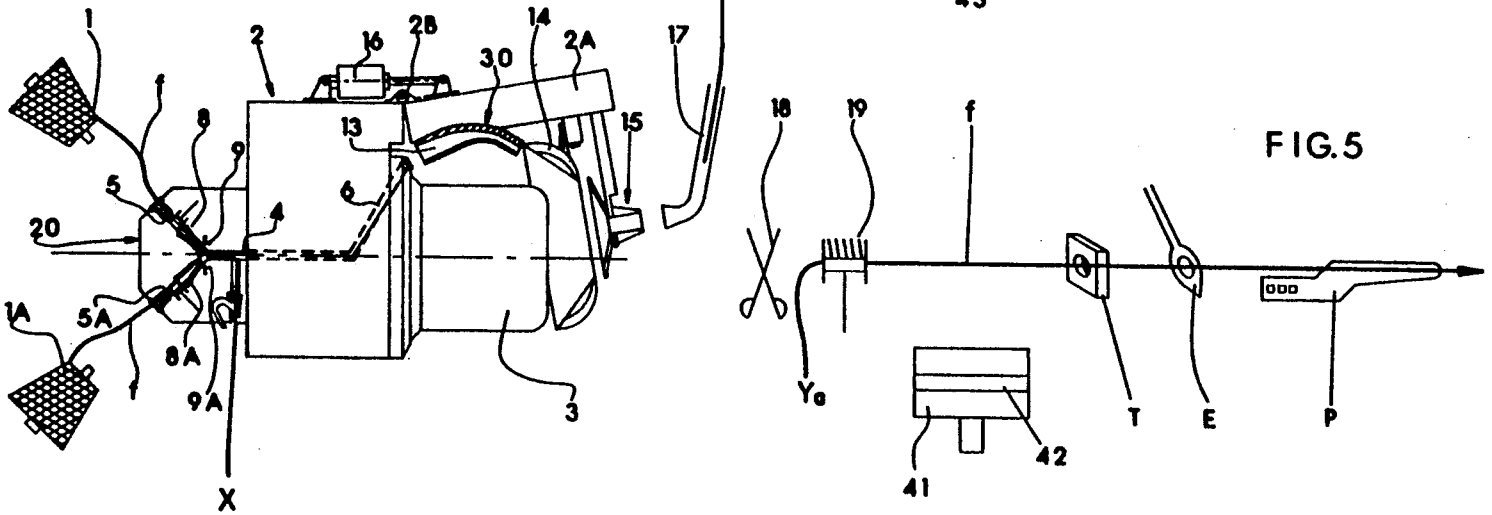
Figure 6:
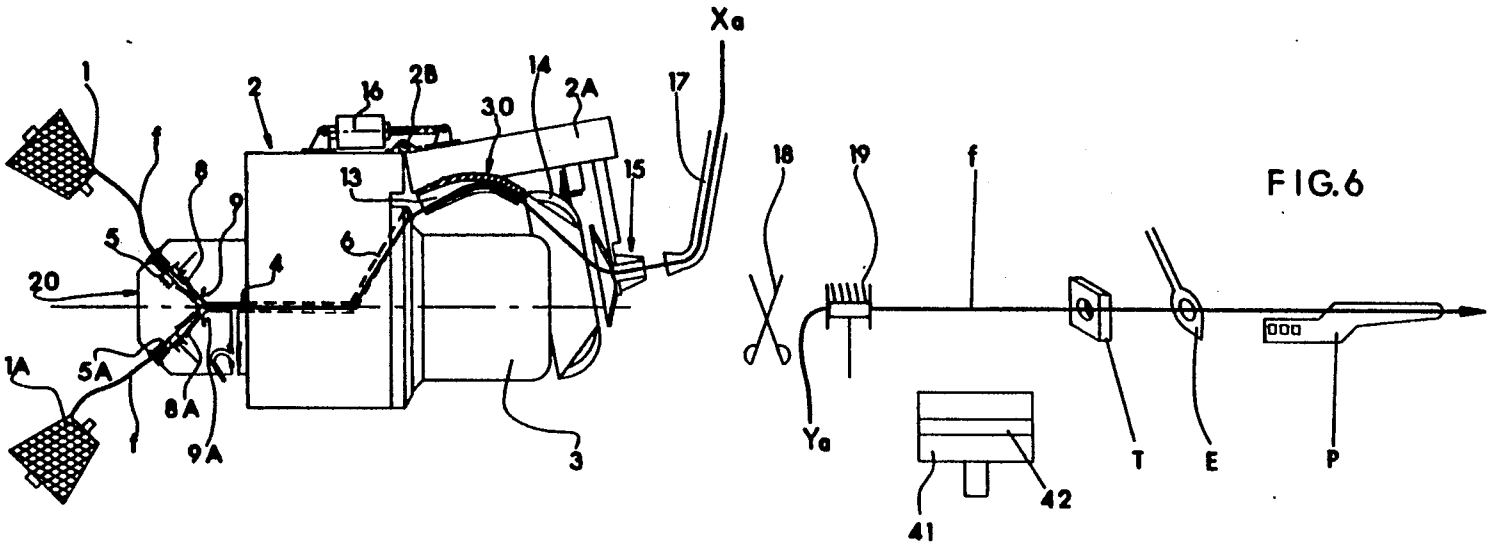
Figure 7:
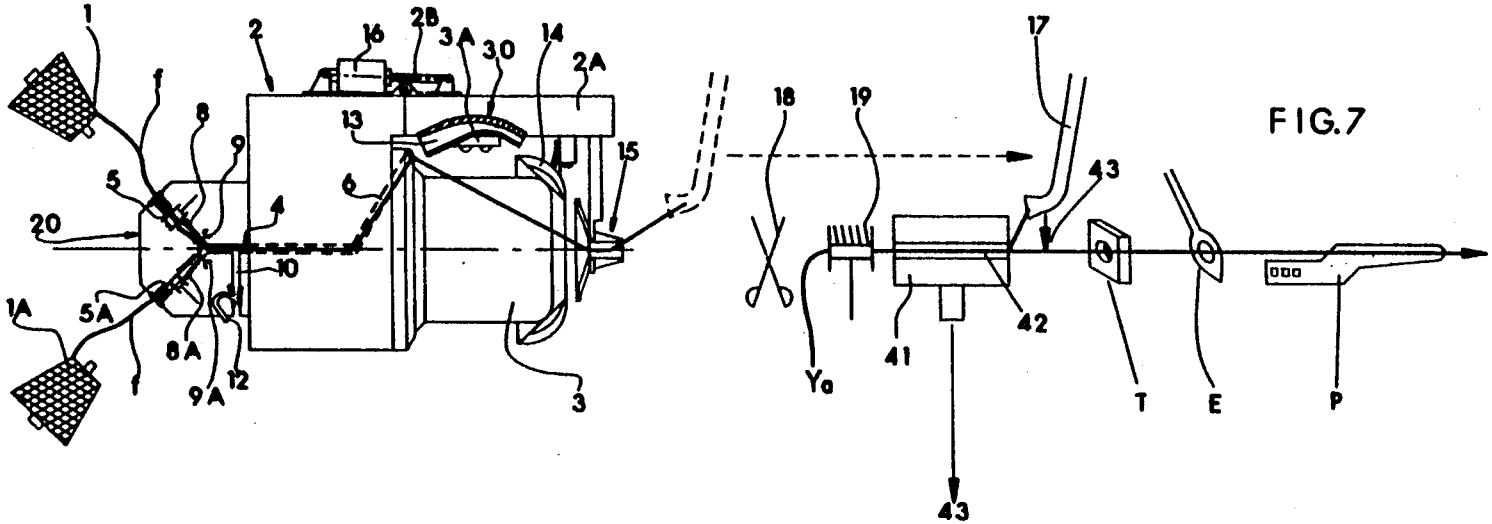

As shown in FIG. 1, the invention is applied to a weft feeder 2 interposed between feed spools 1, 1A and a gripper loom, of which only the carrying gripper P is illustrated. As known, such a weft feeder (FIGS. 1 to 7) is essentially formed of a main body housing an electric motor adapted to rotate a winding arm 6, and of a drum 3 idly mounted on the motor shaft, but held stationary, around which the arm 6 winds up the yarn f into even turns, forming a certain amount of weft yarn reserve detected by sensors (photoelectric cells) 3A carried by a bracket 2A positioned alongside the drum 3. Brake means 14, mounted at the end of the bracket 2A, act in a known manner on the drum. These brake means consist of an annular element with elastic laminae (FIGS. 1 and 4 to 7) or of an annular brush element (FIGS. 2 and 3).

With reference to the accompanying drawings, it should first of all be premised that, in the arrangement of FIG. 1, the lack of yarn due to running out of the spool 1 (or 1A) is equivalent to yarn breakage at the inlet of the weft feeder 2. On the other hand, yarn breakages can occur upstream of, along, or downstream of the weft feeder 2: more generally, the interruption occurs on the weft feeder drum 3, leaving apart two distinct yarn ends, a first end connected to the spool 1 and the other end connected to the loom gripper P.

According to the invention after breakage, any yarn left on the weft feeder is removed therefrom. A new yarn end is automatically introduced through the weft feeder (which is suitably prearranged for this purpose). The weft feeder is reset for operating conditions, and the yarn reserve is formed again.

To carry out this method, the invention proposes to equip the weft feeder with suitably co-ordinate mechanical and electromechanical compressed air (or pneumatic) devices. Thus, a pneumatic yarn introducing device 20—two different embodiments of which are shown respectively in FIG. 1 and in the following figures—is provided first of all at the inlet of the weft feeder 2. This is a body crossed by a duct 4—or respectively by two ducts 5, 5A converging into a duct 4—into which are introduced the weft yarns f fed from the spools 1 and 1A, according to whether the weft feeder and the loom are fed from a single or from a double spool. The duct 4 is positioned in correspondence of the cavity 6A of the winding arm 6 and of the motor shaft of the weft feeder 2, along the longitudinal axis of the latter.

Along the duct 4—or the ducts 5, 5A—there are positioned in succession, starting from the inlet hole:

weft yarn clamping grippers 7, 7A, controlled by electromechanical or electropneumatic actuators;

pneumatic nozzles 8, 8A, fed with compressed air through pipes controlled by solenoid valves or like, so as to launch the weft yarn f towards the inlet of the weft feeder, in correspondence of the cavity 6A of the winding arm 6;

shears or cutters 9, 9A to cut the yarns, also controlled by actuators.

Furthermore, a duct 10 branches off from the portion of the duct 4 closest to the inlet of the weft feeder 2, said duct 10 communicating with the exterior and ending with a nozzle 11, into which compressed air can be let from a duct 12 by opening a solenoid valve, so as to produce a suction pressure which sucks the weft yarn out of the duct 4 and removes it.

According to the invention, a second pneumatic device 30 is provided on the weft feeder to the side of the yarn reserve winding drum 3. This device comprises a curved and suitably profiled duct 13, fixed on the body of the weft feeder 2, or onto its bracket 2A which also carries further along the brake means 14. The device 30 is meant to guide the yarn f, coming from the inner cavity 6A of the winding arm 6, into a suction nozzle 15 mounted at the end of the bracket 2A and positioned at the outlet of the weft feeder 2, centered on its axis and downstream of the brake means 14.

The outlet of the cavity 6A of the winding arm 6 should face exactly the inlet of the fixed duct 13, so that air and yarn may be sent into this latter with practically no pressure and speed losses; means (not shown) are hence provided to stop the winding arm 6 in the exact corresponding angular position: these can consist of a permanent magnet, positioned on the winding arm, and of a sensor fixed on the weft feeder.

Compressed air can be blown into the duct 13 of the device 30 from a nozzle controlled by a solenoid valve and emerging from the intra-dos of the outer wall of the duct 13, in order to draw the yarn f (thereby increasing the pressure on said yarn, to help it reach the suction nozzle 15). Aerodynamic guide means for the yarn can moreover be provided in the duct 13, as an alternative or in association to said nozzle.

Nevertheless, the duct 13 may also not be provided with such a nozzle (as in the case illustrated on the accompanying drawings) when the air jet blown from the device 20 is sufficient to send the yarn as far as the suction nozzle 15 at the outlet of the weft feeder 2.

Once the yarn f is introduced into the duct 13, it should be left free to wind around the surface of the drum 8: said duct should hence be open (as shown) or adapted to open longitudinally towards the drum.

Other characteristic details and or variants of the device 30 can be found in the European Patent Application No. 90118455, by the same Applicant, which describes and illustrates a similar device equipping a measuring weft feeder for fluid jet looms, whereon said device has been applied for the first time.

According to the present invention, the bracket 2A of the weft feeder 2, carrying the brake means 14 and the suction nozzle 15, is articulated in respect of the weft feeder body by means of a hinge 2B, about which it can be oscillated by a pneumatic cylinder 16, or by similar means, so as to move the brake means 14 away from the end surface of the drum 3, as shown in FIG. 3.

The suction nozzle 15, carried by a rod 2C projecting from the end of the bracket 2A and fixed thereto, preferably comprises an eyelet 15A, a trumpet 15B adapted to facilitate inlet of the yarn sent from the device 30, and a compressed air nozzle 15C.

A suction mouth 17, which forms part of the weft feeder or is associated thereto, is provided downstream of the nozzle 15. The outlet of the nozzle 15 is positioned in correspondence of said mouth 17 when the weft feeder bracket 2A has been oscillated (FIG. 3) so as to move the brake means 14 away from the drum 3.

Furthermore, shears 18 and a clamping gripper 19, preferably combined into a single unit 40, can be associated to the weft feeder 2 (in a fixed position between the feeder and the loom to be fed, whose carrying gripper P is shown in FIG. 1), centered along its axis.

FIG. 1 and FIGS. 4 to 7 of the drawings also show a weft feeler T and a presenting element E, interposed in known manner between the weft feeder 2 and the loom.

The operation of the weft feeder according to the invention shall now be described in detail, with reference to the accompanying drawings, considering the more general case, illustrated by the diagrams of FIGS. 4 to 7, of yarn breakage in correspondence of an intermediate point of the yarn reserve wound around the drum 3, which has been detected by the photoelectric cell 3A of the weft feeder 2.

In these conditions, when the photoelectric cell 3A issues a signal, there are a few weft yarn turns left on the drum 3 and the two yarn ends X and Y, respectively upstream and downstream of the interruption, are on the drum 3 (FIG. 4) when the loom stops due to the signal. The following steps then take place in succession:

The pneumatic cylinder 16 is operated and the weft feeder bracket 2A oscillates, moving the brake 14 away from the drum 3 (FIGS. 3 and 5) and positioning the nozzle 15 in correspondence of the suction mouth 17.

The clamping gripper 7 closes and the yarn is cut by the shears 9; the yarn left on the winding arm 6 and on the drum 3 is sucked back and removed through the duct 10 by means of the nozzle 11, while the winding arm 6 rotates counterclockwise to unwind the yarn turns which are still on the left side of the drum, until the yarn end X is removed; the winding arm then stops with its cavity 6A in alignment with the duct 13.

At the same time, the clamping gripper 19 closes; the shears 18 cut the yarn f downstream of the weft feeder 2; the yarn left on the drum 3, to the right of the end Y, is sucked into the mouth 17 through the nozzle 15 and removed. The situation is that shown in FIG. 5, with an empty weft feeder and the brake means 14 away from the drum 3.

The pneumatic nozzle 8 in the yarn introducing device 20 now starts to operate; the clamping gripper 7 opens and the yarn f is introduced through the inner duct 4 and sent into the cavity 6A of the winding arm, until it reaches the duct 13 of the pneumatic device 30. From here, the yarn f is directed, after having freely crossed the ring of the brake means 14, to a fixed point where the eyelet 15A of the suction nozzle 15 has been moved, that is, in correspondence of the suction mouth 17. Thus, the new leading end Xa of the yarn f which is easily introduced into the nozzle 15 thanks to the trumpet 15B, is sucked into the mouth 17, and the situation is that shown in FIG. 6.

The oscillation of the bracket 2A is then reversed, moving the brake means 14 and the nozzle 15 back into an operating position (FIG. 7); the weft feeder is reset so as to form again the yarn reserve on the drum 3.

At this point, the new yarn end Xa has to be knotted again to the other starting end Ya, clamped by the gripper 19 and still inserted into the elements T, E, P, so as to be fed to the loom. To allow the feeding, the mouth 17, which retains the yarn f by suction, can be shifted towards the loom (FIG. 7), in alignment with the yarn feeding line, so that the new yarn f may be introduced into the rectilinear guide 42 of a mechanical or pneumatic knotter 41, with the two ends Xa and Ya parallel and contacting each other. The knotter 41 should move transversely to the path of the yarn f, as indicated by the arrows 43 in FIG. 7, so as to withdraw as soon as the knotting has been done.

Of course, the weft yarn may break at points other than in correspondence of the drum 3. In the event of yarn breakage occurring further downstream and being detected by the weft feeler T, the knotter is no longer required, as the yarn end Y is missing; in this case automation can only be partial and an operator is required to re-introduce the yarn into the weft feeler T, into the element E of the presenting device and into the weft carrying gripper P.

The same happens in the event of yarn breakage between the spool and the weft feeder, with no possibility to replace the spool. The following manual operations should then be carried out:

- introducing a new yarn end into the inlet hole of the device 20;
- operating, by a manual control, the nozzle 8 which launches the yarn f as far as the drum;
- knotting the new yarn end to the one left on the weft feeder and restarting the loom.

A partial automation can also be provided for the general case (first considered) of yarn breakage on the drum; while an even more reduced automation can be provided for the other two cases, by relying for example on the operator to knot the two yarn ends, and/or to cause the oscillation of the weft feeder bracket 2A. This of course simplifies the structure and operation of the weft feeder according to the invention, without however forgoing most of the advantages obtained by this simplified structure. Furthermore, automatic yarn introduction can be limited to the weft feeder.

It is understood that for the purpose of reducing automation, and for other purposes which may involve the construction and operation of the weft feeder, or even simply for commercial purposes, the embodiments according to the present invention may undergo modifications and variants without however departing from the scope of protection thereof. In particular, a different method could be adopted to move the brake means 14 away from the end of the drum 3, so as to allow the weft yarn to reach the suction nozzle 15 and move beyond. A method which at once appears possible is to cause the rectilinear instead of the rotary oscillation of the weft feeder bracket 2A. Other modifications could concern the configuration of the devices 20 and 30 and of the unit 40, the choice and combination of the components used therein, and the manner of operating the same, as well as the design and working details of the suction mouth 17, and of the knotter 41.

I claim:

1. In a weft feeder for a projectile loom, of the type comprising a body housing a motor, a drum idly mounted on a motor shaft and held stationary around which a winding arm rotated by the motor winds up a weft yarn reserve, a bracket positioned alongside the drum and carrying means for detecting and controlling the yarn reserve, said bracket also carrying brake means for braking the weft yarn against an end surface of the drum, and means for automatically restoring the continuity of the weft yarn from a feed spool to the loom, the improvement wherein said means for restoring the continuity of the weft yarn consist of three compressed air devices acting on said yarn, the first device being positioned at an inlet of the weft feeder for withdrawing therefrom broken yarn and introducing therein new yarn fed by the spool, and including at least a first duct having an outlet connected to the inlet of the weft feeder, wherein positioned along said first duct are clamping means, nozzle means and cutting means, and a second duct branching off from said first duct, close to its outlet, said second duct also having nozzle means; the second device being positioned adjacent to the weft feeder drum for receiving the new yarn fed by said first device and by the winding arm and for sending it to a fixed point, and including a curved profiled duct; and the third device including at least a suction nozzle having an inlet, said suction nozzle being mounted downstream of the brake means, at the end of the bracket, said bracket being mounted on the weft feeder body housing the motor so as to be moved away from the end of said drum, with the brake means, thereby moving said brake means and said suction nozzle from their usual position centered on the weft feeder axis, to a position in which the inlet of the suction nozzle coincides with said fixed point.

2. Weft feeder as recited in claim 1, wherein a suction mouth acts in combination with said suction nozzle of the third compressed air device, when the inlet of said suction nozzle coincides with said fixed point.

3. Weft feeder as recited in claim 2, wherein additional cutting means, additional clamping means, and knotting means are provided downstream of said weft feeder.

4. Weft feeder as recited in claim 1, wherein the first duct of said first compressed air device forks into two branches to allow feeding the weft feeder from two spools.

5. Weft feeder as recited in claim 1, wherein the movement of said bracket away from the drum is automatically controlled by a compressed air cylinder or other fluid pressure means or electromechanical devices.

6. Weft feeder as recited in claim 1, wherein the bracket is hinged onto the body housing the motor, at its end opposite to that carrying the brake means and the suction nozzle, so as to oscillate away from the drum.

7. Weft feeder as recited in claim 1, wherein the curved profiled duct forming said second compressed air device opens longitudinally towards the drum.

8. Method to automatically restore the continuity of weft yarn fed from a spool to a weft transport means of a projectile loom, through a weft feeder of the type comprising a body housing a motor, a drum idly mounted on a motor shaft and held stationary around which a winding arm rotated by the motor winds up a weft yarn reserve, a bracket positioned alongside the drum and carrying means for detecting and controlling the yarn reserve, and also carrying brake means for braking the weft yarn against an end surface of the drum, and means for automatically restoring the continuity of the weft yarn from a feed spool to the loom, said method comprising the following sequence of steps of which at least some of the steps are carried out automatically:

stopping the loom in response to a detected signal indicative of yarn absence or breakage;

moving the brake means away from the weft feeder drum;

emptying the weft feeder by removing and eliminating any yarn left thereon;

introducing new yarn in the weft feeder;

returning the brake means to an operating position;

knotting any broken yarn downstream of the weft feeder;

establishing a weft yarn reserve on the weft feeder drum; and starting the loom.

9. Method as recited in claim 8, wherein some of the steps are carried out manually instead of automatically.

* * * * *